US006125851A

United States Patent [19]

Walker et al.

[11] Patent Number: 6,125,851

[45] Date of Patent: Oct. 3, 2000

[54] SPINAL SUPPORT SYSTEM FOR SEATING

[76] Inventors: Brock M. Walker, 4095 Hullet Rd., Okemos, Mich. 48864; Edward E. Timm, 6860 N. River Rd., Freeland, Mich. 48623

[21] Appl. No.: 08/893,177

[22] Filed: Jul. 15, 1997

Related U.S. Application Data

[63] Continuation of application No. 08/289,372, Aug. 12, 1994, abandoned.

[51] Int. Cl.[7] ..... A61G 15/00

[52] U.S. Cl. ..... 128/845; 128/846; 297/284

[58] Field of Search ..... 128/845, 846, 128/DIG. 23; 297/284; 602/5, 13, 19

[56] References Cited

U.S. PATENT DOCUMENTS

| | | | |
|---|---|---|---|
| D. 277,316 | 1/1985 | Meares . | |
| D. 296,930 | 7/1988 | Carabelli . | |
| D. 321,760 | 11/1991 | Carney . | |
| D. 325,087 | 3/1992 | Brinker . | |
| 1,510,187 | 9/1924 | Martin . | |
| 1,667,626 | 4/1928 | Epstein . | |
| 1,716,871 | 6/1929 | Weldon . | |
| 2,139,028 | 12/1938 | Mensendicck et al. . | |
| 2,219,475 | 10/1940 | Flaherty . | |
| 2,554,337 | 5/1951 | Lampert . | |
| 2,663,359 | 12/1953 | Wood . | |
| 2,769,485 | 11/1956 | Shapiro . | |
| 2,831,533 | 4/1958 | Pasquarelli . | |
| 2,855,986 | 10/1958 | Engelen, Sr. . | |
| 3,024,784 | 3/1962 | Monfardini . | |
| 3,138,404 | 6/1964 | Newton . | |
| 3,145,054 | 8/1964 | Sopko, Jr. . | |
| 3,189,917 | 6/1965 | Sims . | |
| 3,288,525 | 11/1966 | Cerf | 297/284 |
| 3,348,880 | 10/1967 | Swann | 297/230 |
| 3,362,402 | 1/1968 | Loeffel et al. . | |
| 3,497,872 | 3/1970 | Mitchell . | |
| 3,501,197 | 3/1970 | Burton . | |
| 3,512,835 | 5/1970 | Flototto . | |
| 3,568,670 | 3/1971 | Gaylord, Jr. . | |
| 3,642,319 | 2/1972 | Berchicci . | |
| 3,657,739 | 4/1972 | Holmes, Sr. . | |
| 3,713,657 | 1/1973 | Presta . | |
| 3,717,143 | 2/1973 | Johnson | 602/19 |
| 3,720,441 | 3/1973 | Corchran . | |
| 3,740,096 | 6/1973 | Bridger . | |
| 3,855,631 | 12/1974 | Ettinger . | |
| 3,900,896 | 8/1975 | Ackerman . | |
| 3,904,242 | 9/1975 | Koepke et al. . | |
| 3,926,183 | 12/1975 | Spiro . | |
| 3,927,665 | 12/1975 | Wax . | |
| 3,964,474 | 6/1976 | Fox . | |
| 4,034,747 | 7/1977 | Leroy . | |
| 4,099,524 | 7/1978 | Cueman et al. . | |
| 4,156,544 | 5/1979 | Swenson et al. . | |
| 4,175,553 | 11/1979 | Rosenberg . | |
| 4,219,193 | 8/1980 | Newman . | |
| 4,338,685 | 7/1982 | Laport, Jr. . | |
| 4,471,993 | 9/1984 | Watson . | |
| 4,475,543 | 10/1984 | Brooks et al. . | |
| 4,489,982 | 12/1984 | Morrow . | |
| 4,501,023 | 2/1985 | Bilberry . | |
| 4,502,728 | 3/1985 | Sheldon et al. . | |
| 4,516,568 | 5/1985 | Baxter et al. . | |

(List continued on next page.)

FOREIGN PATENT DOCUMENTS 3905115 8/1990 Germany .

OTHER PUBLICATIONS

Meares; Instruction Booket—SACRO WEDGY; Corresponds to Design Patent No. 277,316, dated Jan. 1985.

*Primary Examiner*—Michael A. Brown
*Attorney, Agent, or Firm*—Pillsbury Madison & Sutro LLP

[57] ABSTRACT

A spinal support device for applying a directed and concentrated force on the sacrum to position the sacrum and pelvis to thereby establish a desired spinal posture when in a seated position. The device provides isolatable force on the sacrum from the sacral base line downwardly to a bottom seat surface and for a width across an individual's back approximately equal to twice the dimension of the posterior portion of the individual's sacrum.

50 Claims, 8 Drawing Sheets

U.S. PATENT DOCUMENTS 4,522,447 6/1985 Snyder et al. .
4,535,495 8/1985 Oldfield .
4,556,254 12/1985 Roberts .
4,559,933 12/1985 Batard et al. .
4,572,578 2/1986 Purkins ..... 297/460
4,576,154 3/1986 Hyman et al. .
4,597,386 7/1986 Goldstein ..... 602/19
4,634,176 1/1987 Scott .
4,638,510 1/1987 Hubbard .
4,643,174 2/1987 Horiuchi .
4,715,362 12/1987 Scott .
4,718,724 1/1988 Quinton et al. .
4,753,478 6/1988 Weinreich .
4,757,554 7/1988 Blair .
4,789,202 12/1988 Alter ..... 297/284
4,821,339 4/1989 Fair .
4,824,169 4/1989 Jarrell .
4,836,194 6/1989 Sebastian et al. .
4,854,306 8/1989 Pujals, Jr. .
4,862,536 9/1989 Pruit .
4,870,705 10/1989 Higby et al. .
4,876,755 10/1989 Parrish .
4,881,529 11/1989 Santos .
4,926,845 5/1990 Harris ..... 602/19
4,930,499 6/1990 Rowe ..... 602/19
4,981,325 1/1991 Zacharkow .
4,996,720 3/1991 Fair .
5,054,854 10/1991 Pruit .
5,105,806 4/1992 Woodhouse et al. .
5,114,209 5/1992 Dunn .
5,188,585 2/1993 Peters .
5,190,347 3/1993 Shiow-Lan .

10
12
14
16
18
20
22
24
26
28
30
32
34
36
38
39
40
42
44
46
48
50
52
L-1
L-2
L-3
L-4
L-5

SPINAL SUPPORT SYSTEM FOR SEATING

This is a continuation of application Ser. No. 08/289,372, filed on Aug. 12, 1994, which was abandoned upon the filing hereof.

BACKGROUND OF THE INVENTION

1. Field of the Invention

The present invention relates to an improvement in a back support system that establishes a desired postural position by creating specific sacral pressure and to apparatus that will properly position the sacrum, the pelvis, including the iliac crests, and the supporting neuro-musculo-skeletal system to produce total pelvic stability.

2. Description of the Prior Art

Back pain, in concept and in fact, is not only prevalent in society but is an area of much research and patent activity. Back pain is something many individuals experience at work, at home, and during the trip therebetween. Back pain has many causes, but few cures. The latter is not for a want of trying. Rather, patents on a wide variety of back supports or support systems abound.

For example, the patents can be generally divided in groups including those relating to seat developments, sacral or lumbosacral braces, fixed cushions or supports, and inflatable devices.

The seat development area can be further subdivided into built-in supports, add-on supports, orthopedic seats, back rests, and office chair designs.

Prior to a summary review of these prior efforts, it should be understood that non-pathogenic back pain usually results from the presence of stress or pressure on the neuro-musculo-skeletal system and affected interrelated anatomical structure. Sometimes that stress or pressure is generated internally within the spinal cord. In either case, the resulting stress can be due to inappropriately applied pressure or due to a distorted or damaged spinal column that has existed for varying periods of time, with resulting pain depending on the prior state of the spinal cord. Consequently, in many situations the neuro-musculo-skeletal system can be supported to either relieve or prevent development of unwanted and undesirable spinal pressure.

An early spine support device is described in Epstein, U.S. Pat. No. 1,667,626. A wooden frame is used to mount a series of spring bands that form a curved face. A batting material fills the space between vertical braces and the whole device was covered with fabric. Using adjustable hooks the device was adjustable to accommodate different sized persons. The device has a width about equal to a person's back and is shown being positioned in the lumbar region to provide uniform support over a broad region.

The built-in devices are exemplified by Sopko, Jr. U.S. Pat. No. 3,145,054 and Burton, U.S. Pat. No. 3,501,197. Sopko relates to a portable chair that incorporates a contoured pneumatic cushion which applies pressure to the posterior surface, in the sacroiliac area, and varies the pressure by forward and rearward movement of the occupant against the back supporting pneumatic cushion.

Burton attempts to restrict the body's movement into the back/seat junction area, where the ischial tuberosities of the pelvic girdle wedges into this back/seat area, by incorporating a rigid back/seat element into the seat to prevent such wedging.

The add-on devices include a variety of devices as shown in Weinreich U.S. Pat. No. 4,753,478; Quinton et al. U.S. Pat. No. 4,718,724; Baxter et al. U.S. Pat. No. 4,516,568; Scott U.S. Pat. No. 4,634,176; and Pasquarelli U.S. Pat. No. 2,831,533.

Each of these devices includes a portion that extends across the entire back of the person as seated in the seat. In Weinreich the support is in the form of a pair of tubular cushions. Quinton et al. suggest that it had proved difficult to standardize the location of lumbar support cushions and thus developed a vertically adjustable lumbar support cushion. Baxter et al. disclose a multi-compartment air bladder, including side and center sections, so that air pressure can be applied on selected lumbar and sacroiliac areas of the body. Scott also provided a vertically movable back support, but it has a greater area than that of Quinton et al. Pasquarelli discloses use of a dorso-lumbar curve support in the form of an elongated cushion that applies pressure across the full width of the person's back.

The lumbosacral braces include Rowe, U.S. Pat. No. 4,930,499; Brooks et al., U.S. Pat. No. 4,475,543; Hyman et al, U.S. Pat. No. 4,576,154; Carabelli, U.S. Pat. No. Des. 296,930; and Lampert, U.S. Pat. No. 2,554,337.

Several patents disclose use of a fixed cushion. These include Parrish, U.S. Pat. No. 4,876,755; Snyder et al, U.S. Pat. No. 4,522,447; and the Meares design patent, U.S. Pat. No. Des. 277,316. The cushion used by Parrish is shaped as a capital "I" and supports the cervical, thoracic and lumbar regions. Snyder et al. designed foam cushions with segments having varying degrees of elasticity to provide inversely proportional support for both seating and backrest surfaces with the softest material provided where pressure would be highest.

Meares shows a design for an orthopedic device that provides full sacral pressures. The design patent does not explain how this device works or functions. However, an associated instruction book explains that the device is to be used by a person primarily in a horizontal condition. The device, while constructed from rubber in soft foam rubber, has a hollow interior and the edges are stiffer due to the presence of sidewalls that surround the hollow interior. Thus, the resistance provided by the Meares device is not uniform. The center is softer than the peripheral edges.

To use the Meares device while lying on the floor, the device is placed on the floor and the user then rolls over onto the device. The instructions explain that the device has a wide end and a narrow end with the wide end being positioned so that it points toward the head. When one first gets on the device, the knees are to be bent and the tail bone is to be rocked down toward the floor. This movement is claimed to help position the curve of the sacrum (tailbone) into the curvature or cradle formed in the device.

As shown in the design patent, the device includes two raised portions on the anterior surface and a flat rear or posterior surface. Because the device is molded from soft rubber, and has a hollow interior, a wider cradle area is formed between the two raised areas.

The Meares device is about 7.25 inches long and has a width of 2.75 inches at the top and about 1 inch at the bottom. The upper raised area extends for about 2 inches, the cradle area then extends for another 3.25 inches with the lower raised portion extending for about 0.75 inches. Thereafter the device slopes toward the narrow end. The device should be used on a firm surface and the instructions suggest that a book could be used if the person was bedridden or a piece of plywood could be positioned under the hips to provide the feeling of a firm support.

The Meares instruction materials also state that his device can be used in a car, truck or a straight back chair. To use the Meares device in such a situation the rubber device is bent into a curved shape and then it is placed both under and slightly behind the person. The instructions also state the seat cushion is soft, a bendable book could be inserted under the rubber device to increase lift. The bent member should cradle the sacrum as when the device was used on the floor.

Thus, Meares suggests, indeed requires, full sacral pressure that is not adjustable with respect to the intensity of pressure being applied. Meares preference is to create constant pressure while the user is in a supine position.

It is also important to note that Meares isolates pressure along the full length of the sacrum. This is intended to provide a treatment to an injured set of muscles, with the piriformis and psoas muscles being of primary concern. Meares' desire is to literally move the whole of the sacrum upwardly (when lying down—movement is toward one's front). If the sacrum can be moved that way, and the hips are allowed to move in the opposite direction, that is, in a sense, to fall downwardly over the sides of his device, both the piriformis and psoas muscles will be stretched to relieve muscle spasms.

SUMMARY OF THE INVENTION

To gain an appropriate understanding of the utility and effect of the present invention, it is important to first understand the skeletal features of a human body, as well as how such features interact and affect one another. In that regard, reference will be made to the entire neuro-musculo-skeletal system of the human anatomy, as well as the interaction between those anatomical systems.

In a normal person, the spine, when viewed from the front, preferably forms a relatively straight vertical line. The function of the spine is in part mechanical, since it supports the body from the waist up, and in part protective, since it protects and houses the central nervous system or spinal cord. The spine is comprised of seven cervical vertebrae, twelve thoracic vertebrae and five lumbar vertebrae. Below the lumbar vertebrae is the sacrum and below that the bones that form the coccyx. The upper one third of the sacrum is an area identified as the sacral base.

The cervical or upper portion of the spine generally curves forward as a smooth and flexible "C" shaped element which supports the head and a percentage of body weight. This upper portion, because of its high flexibility, allows for rotational movement as well as fore and aft movement.

The thoracic portion of the spine, sometimes referred to as the middle back, will curve in the opposite direction, that is, rearwardly and then forwardly again. The thoracic portion supports the rib cage and the upper body portion above that area. Because the ribs are connected to the thoracic portion of the spine, the ribs themselves prevent the thoracic spine region from being as flexible as the cervical portion, and in fact, make the thoracic portion relatively rigid.

The next portion of the spine, the lumbar region or lower back, again curves in the opposite direction from the curvature of the thoracic portion. The sacral and coccyx portions extend therebelow and again curves forwardly. The lower back portion supports the major portion of the upper body and, consequently, is under more compressive stress than the remaining portions of the spine.

The most normal curvature of the spine is developed when the human body is standing in an upright manner and exhibiting good posture. As the body undergoes changes when getting into a seat and when seated, especially if one is to perform functions while in a seated position, the normal curvature of the spine is generally distorted. This is due to the fact that many, if not most, chairs do not give good spinal support. Consequently, backaches or stresses develop during sitting, especially during extended periods of sitting. Such extended sitting can create aches, soreness and disfunction.

This is true for the common man as well as in specialized instances, such as when race drivers must remain seated in the one position for hours at a stretch.

Thus, one of the principal objectives of the present invention is to support the lumbar lordosis of the spine in a shape similar to the shape found in a normal standing posture, and to provide this support when the individual is seated. One objective of the present invention is to support, principally, the sacral base. The goal is to prevent muscles from spasming by providing support and thus reducing the likelihood of muscle fatigue.

In Bridger, U.S. Pat. No. 3,740,096, there was a recognition that abnormal strains of the spine can be reduced if an occupant's weight is distributed throughout each disc and vertebrae in the spine evenly so that a mechanical balance is created between related antagonistic muscle groups and ligaments. While Murrow, U.S. Pat. No. 4,489,982 and Dunn, U.S. Pat. No. 5,114,209, recognized the importance of correct posture when sitting, they suggested use of full width back or lumbar supports. Neither recognized the importance, or even the desirability, of localized pressure, especially to the sacral base region.

The discs within the spine, separating the vertebrae, are under minimal mechanical load when bearing only compressive stresses resulting from the body's weight. However, when the spine is flexed from its normal curvature, such as when standing erect with good posture, the discs then must bear additional compressive and/or tensile stresses due to forces applied by the muscles and ligaments in order to maintain a mechanical equilibrium when the spine is in a new flexed position. It should be noted that the mechanical load on the neuro-muscular-skeletal (NMS) system differs vastly between sitting and lying down positions.

A great deal of spinal pain can be traced to excessive stresses applied to these discs, the spine or vertebral column and the interrelated neuro-musculo-skeletal system. Consequently, developing an improved seating approach requires that one minimize these neuro-musculo-skeletal stresses when the individual is in a sitting posture. When this is achieved, it provides superior comfort and endurance to an occupant of a seat and provides significant benefit during extended sitting periods.

Many people must perform some function when in a seated position. If this were not the case, then minimizing stresses on the vertebral column could be accomplished relatively simply by inclining the back portion of the seat away from the vertical position to more closely approximate spinal curvature positions when the person was erect. Performing tasks while seated necessarily requires upper body motion. As such motion occurs, it will create varying degrees of stress throughout the neuro-musculo-skeletal system. This is caused by the movement of muscles and ligaments associated with the body motion as movement occurs when the body changes position. Related stresses can also be aggravated by movement, especially when compared with stresses found in a perfectly static seated posture. Motion moves the upper body from its center of gravity, or from an equilibrium position established by the vertebrae, muscles and ligaments holding each vertebrae in the system change position and move in response. As the center of gravity shifts and the equilibrium position changes, this also increases bending moments around each vertebrae thereby placing discs under additional, though varying, stresses.

When seated, the major portion of the upper body, and certainly its center of gravity, is positioned above the fixed end of the spine. When bending of the spine takes it out of its columnar position, and thus out of equilibrium, motion occurs about a joint between the fifth lumbar vertebrae (the vertebrae proximate to the sacrum) and the sacrum. Consequently, one objective of the present invention is to stabilize and correctly orient this lumbo-sacral joint. This is important in providing a functionally active and comfortable seated position where the sacral base is supported. In that condition sitting can be endured for sustained periods. More specifically, if a seating device is arranged so that the sacrum, and in particular the sacral base, is not securely positioned at an angle that allows the spine to support the weight born by the fifth lumbar vertebrae, without requiring additional bending and shear stresses to maintain equilibrium of the spine, then no amount of additional support of the occupant's upper body will result in an optimally functional seat. It will also not provide sitting comfort for an extended time.

The present invention relates to a method and apparatus for supporting the lumbar lordoses of the spine in a manner that achieves a spinal shape similar to the shape found in a person's normal standing posture. This is accomplished, in part, by securely locating a seated person's pelvis relative to a seat, in a position that will maintain good spinal posture while seated. First, the sacrum itself must be properly positioned by locating the sacrum along its posterior surface. This is done by applying pressure directly over the posterior surface of the sacrum, and principally to the upper one third of the sacrum, the sacral base. Secondly, the force generated by such a sacral pressure exerting device must be resisted through a combination of frictional, gravitational or other mechanical means in order to prevent movement of the person in an anterior direction across the surface of the seat or away from the sacral support and away from the supporting force.

The sacral support of the present invention is designed to position the sacrum, but to do so in a way that also permits compression of adjacent soft tissue in a variable manner. The present invention further permits an optional adjustment of specific pressure applied to the sacral base and to change the pressures per square inch at that region. Thus, it is possible to vary the intensity of the specifically applied pressure to the sacral base to thereby achieve the support of and/or movement of the sacrum in a posterior to an anterior direction. This pressure can be directed against the individual at an angle that can vary from, for example, 15–20 degrees, plus and minus from a direction perpendicular to the sacrum. The most effective direction or angle depends upon a number of factors, such as, for example, the shape of the seat, the angle of the seat back relative to the seat bottom, and the size of the person. However, the present invention can provide the desired sacral support, for a seated person, regardless of what position the seat is adjusted to with regard to its angle of incline.

Support of the seated individual is important since the payload on the neuro-muscular-skeletal system is quite different between sitting and supine positions. That payload difference also dictates muscle function without substantially compressing the adjacent soft body tissue in order to maintain a desirable sacrum base angle. The posterior surface of the sacrum has a relatively flat surface and is covered with only a minimum amount of soft tissue and muscle. Thus, it is amenable to be oriented by placing it in close proximity to an orienting surface. This orienting surface will preferably maintain a desirable sacral base angle of from about 20° to 50° from the plane of a substantially horizontal seat, but corrected for inclination of the spinal column from vertical, or for back rest inclination.

Other objects, features, and characteristics of the present invention will become apparent upon consideration of the following description in the appended claims with reference to the accompanying drawings, all of which form a part of the specification, and wherein referenced numerals designate corresponding parts in the various figures.

DETAILED DESCRIPTION OF THE PRESENT INVENTION

Figure 1:
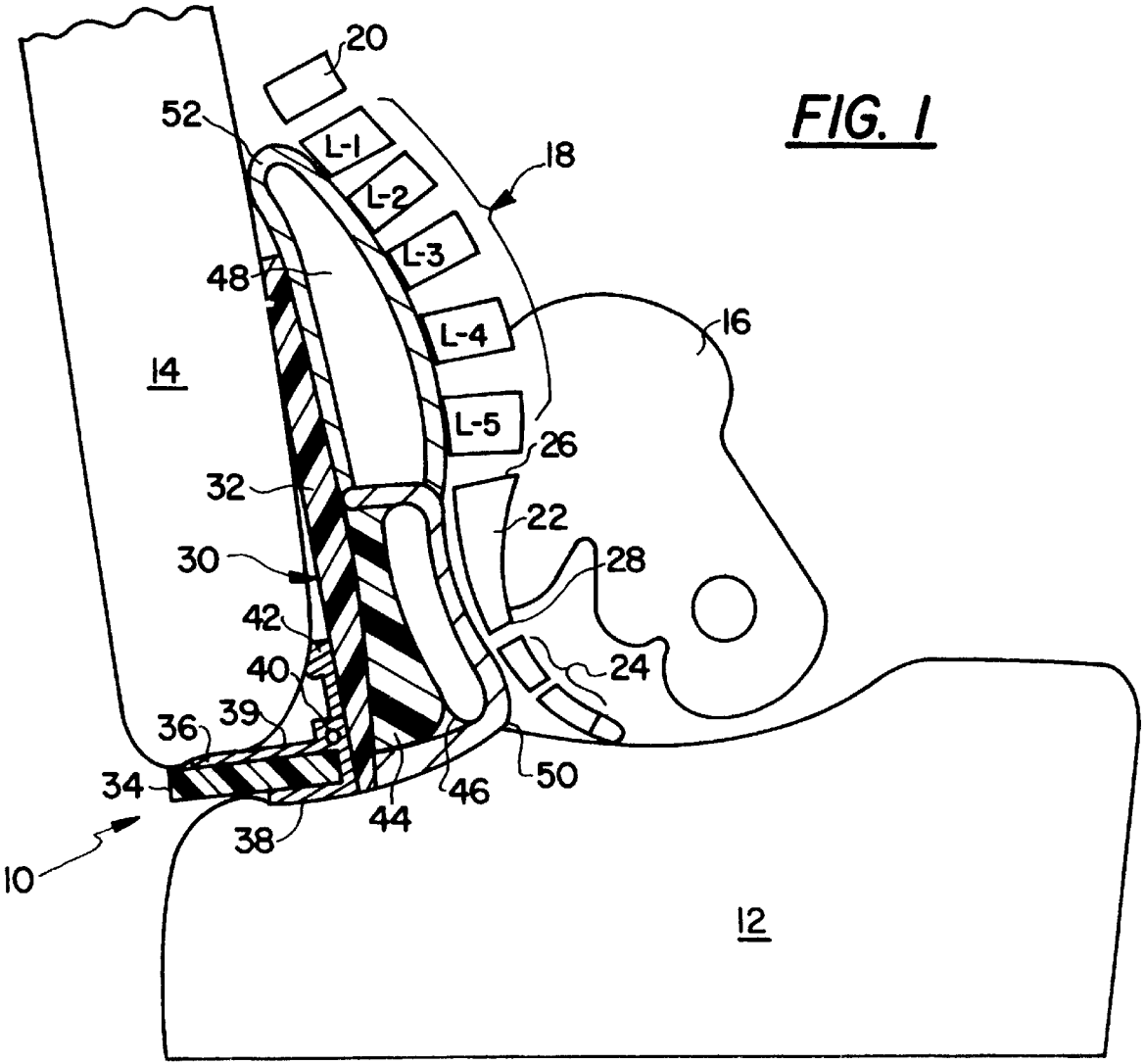
FIG. 1 is a cross-sectional view of the present invention with reference to a seat bottom and seat back, the lumbar vertebrae and the sacrum.

With reference to FIG. 1, one embodiment of the present invention is shown in cross-section, and generally indicated at 10. The device 10 is shown being used between a seat bottom 12 and a seat back 14, with only portions of the seat structure being shown.

In order to correlate the present invention and its effect on certain anatomical components of a person's body, FIG. 1 includes the pelvis 16, the five lumbar vertebrae, generally indicated at 18, with the vertebras specifically referenced as L1–L5, respectively. A first and lowermost thoracic vertebrae is shown at 20. The sacrum is shown at 22 and the upper one third is the region or area called the sacral base is below vertebra L-5. Below sacrum 22 is the coccyx 24, which is comprised of a series of smaller bones that, as a group, tend to curve in an anterior direction. In older adults the smaller coccyx bones can actually fuse together and are considered to be a part of the sacrum.

As noted, the sacrum 22 includes a sacral base or baseline at the top one third of the sacrum, indicated at 26, and a sacral apex at the bottom thereof, indicated at 28.

The present invention can include a base structure, generally indicated at 30, comprised of a vertically extending back brace 32, a bottom member or bracket 34. The bottom member 34, as shown in FIG. 1, can be inserted between the seat back 14 and seat bottom 12 thereby supporting and positioning the invention relative to the seat. As will be pointed out hereafter, this bottom member 34 can have various forms depending upon the configuration of the support device, the seat, or it could be built into a seat. The back 32 is preferably connected to the bottom member 34 by a hinge 40 that includes hinge extensions 36 and 38. This hinge structure can be attached to the back and bottom members by any convenient means, such as glue, epoxy, bolts or screws.

The present invention principally includes a block member 44. Block member 44 provides the support and ability to place localized force or pressure on the sacrum 22, and most directly on the sacral base. Block member 44 is preferably comprised of a rigid material and is shown in greater detail in FIGS. 2 and 3.

It should be understood that this rigid support block member 44 can be used by itself, with or without a cover and with or without the base structure 30 described above. Block member 44 could also include, or be provided with, various additional members attached to it, either removably or permanently. For example, attached to its anterior or front face could be a form of padding, or a hydraulic bladder, as shown in FIG. 1 at 46, or a combination thereof. The padding could be comprised of a textile material, either woven or knitted, a non-woven material, batting, a foam layer, a gel filled bladder or other man-made or synthetic padding or body conforming material. The goal is to provide an area of localized force but to simultaneously minimize development of isolated points of contact. The preferred effect from the use of block member 44 is to provide sufficient force or pressure on the sacrum, without substantial compression of adjacent soft tissue, and to develop the desired control over pelvic rotation. The padding or surface material on block member 44 will also aid in isolating out or damping vibration to the sacrum 22.

In situations when block member 44 is to be used by itself, a rearwardly extending seat support or engagement flap, preferably flexible, could be provided as described in more detail hereafter. This flap would slide between the seat back 14 and bottom cushion 12 to allow proper placement of the block member 44 on the seat and to hold block member 44 in place.

Block member 44 should itself preferably be stiff enough so that it will not bend or flex, easily or substantially, nor be easily moved from its predetermined position in the seat. It can be constructed, fabricated or molded from a variety of materials including plastic, reinforced plastic, rigid foam, metal or other similar materials. Further, this invention is intended to encompass use of a curved member that will, in use against the posterior of an individual, flatten or conform to the shape of the sacrum under a 1–4 pounds per square inch (psi) load.

Where a hydraulic bladder is used as the padding 46, it is preferably filled with an inert liquid, having a viscosity varying from about 0.01 to about 10,000 poise at 20° C. Such material may include flowable gels or thixotropic gels. Also, the bladder could be pneumatic and employ a fixed or variable volume of air or other inert gas. Where a variable volume of gas is desired, use of a conventional pneumatic pump, either hand operated or as part of an automatic system, could be used. Because these are conventional, further description is not believed to be required.

Desirable benefits of using such bladder or members include providing a degree of protection for the individual, preventing development of point forces and dampening the effect of any shocks during use. Also, use of the volume adjustable bladders allows the intensity of the force provided by block member 44 to be adjusted.

As another alternative, the rigid block member 44 could have its anterior or front face covered with "CONFOR" foam, a type of material that is designed to conform to shapes placed against it. The bladder could also be filled with water or a gel that would protect the soft tissue and dampen movement and vibrations.

Figure 2:
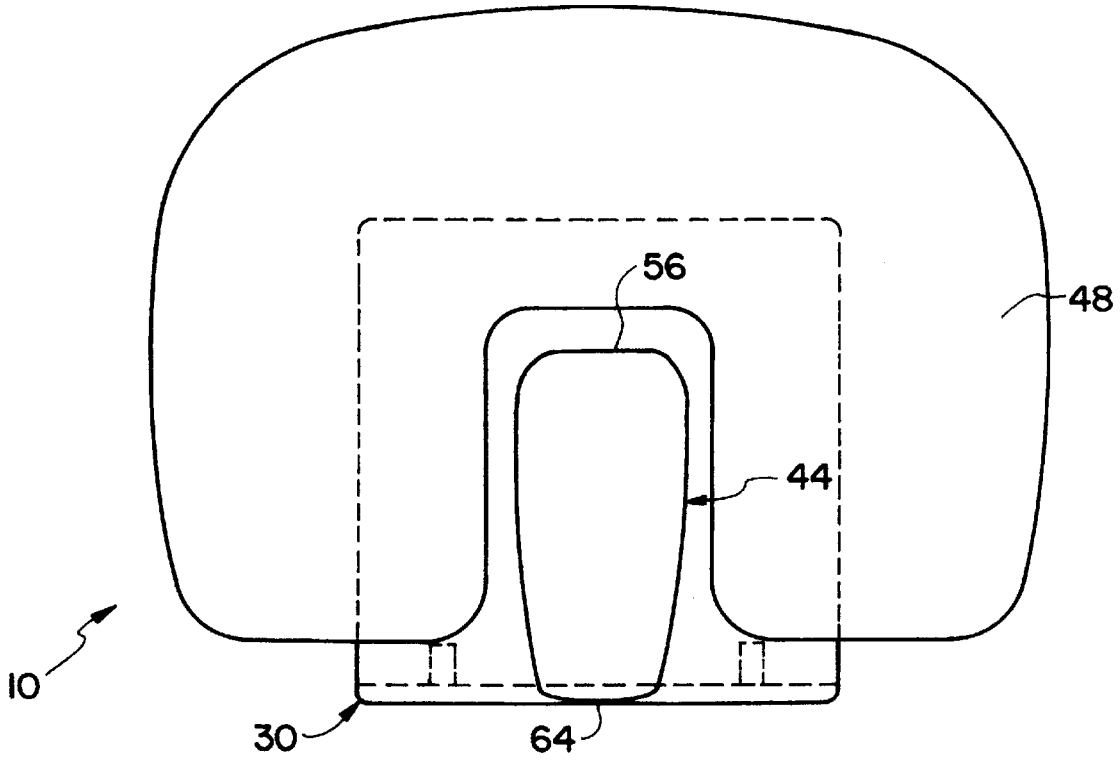
FIG. 2 is a front elevational view of the present invention.

Positioned above the rigid sacral support block member 44, and the padding 46, is an additional support member 48, which has a generally U-shaped form as shown in FIG. 2. The surrounding support 48 can be a fluid filled bladder or foam and is preferably designed to provide lumbar and muscle support specifically for the supra-pelvic muscles and para-vertebrae muscles. However, the area of support 48, which can be about 100 square inches but can vary from 20 $in^2$ to 200 $in^2$, preferably provides less anterior pressure to a human body than does block member 44. For example, the support 48 could be about 10 inches high and 12 inches wide but its dimensions could vary from about 5 to about 20 inches in height and from about 6 to about 24 inches in width. The ratio of anterior pressures applied by block member 44 relative to support 48 will be preferably about 2:1, but could vary from about a 1.1:1 ratio to about a 10:1 ratio.

The amount of anterior force preferably exerted by the whole assembly 10 to the sacrum 22, and primarily the sacral base, will range from about 20–40 pounds in a seat belt type car seat environment. The applied force in an office chair configuration will be about 10 pounds since only friction and gravity can resist the application of anterior forces. These forces could also range from 10 to 50 pounds in a car seat environment and from about 5 to about 25 pounds in a fixed or office type chair.

A cover 50 can be provided over the rigid sacral support member 44 and the padding 46. A cover 52 could also be provided on the exterior of the support 48. It would also be possible to have one cover extend over the whole assembly 10. Such a cover could be loose or a shrink-wrap type conforming cover.

While the device 10, as shown in FIG. 1, is a separate unit that can be easily placed into position by sliding the bottom bracket 34 in between the seat back 14 and the seat bottom 12, with similar easy removal of the device 10, this structure could also be built into the seat back 14. In that case, the covers 50 and 52 would be replaced by the main cover for such a seat.

Figure 3:
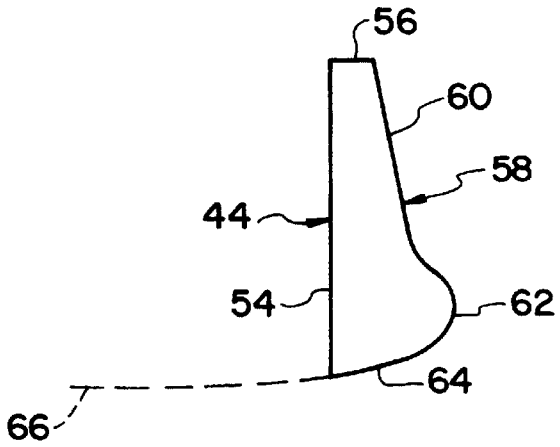
FIG. 3 is a side view of the rigid sacral support.

As shown in FIG. 3, the rigid sacral support block member 44 includes a rear surface 54, a top surface 56, and a front or anterior surface generally indicated at 58 and a bottom surface 64 (see also FIG. 2). That front surface 58 includes both a sloped or slightly curved upper portion 60 and an enlarged or bulbous portion 62 adjacent the bottom surface 64 in the lower portion of block member 44. This latter enlarged portion extends anteriorly or forwardly beyond the upper portion 60. The surface below portion 62 is also sloped rearwardly to form a bottom surface 64. What is important is that the front or anterior surface 58 provide specific pressure contact, along a relatively narrow side-to-side path along the spine of a person seated against block member 44, in the area of the sacrum 22 (FIG. 1) and specifically along the posterior surface thereof so that localized force is applied to the sacrum 22, and in a most preferred embodiment proportionally greater force will be applied to the sacral base portion of the sacrum 22. If the anterior surface 58 has a sufficient elongated curvature the bulbous portion could be subsumed, in a more gradual curve, within the overall curvature of surface 58 still extending outwardly at the bottom 64 so that the whole sacrum 22 is supported with supporting forces still being concentrated on the sacral base. As the upper portion 60 of front surface 58 is more of a ramp or slope, then the desired lower sacral applied pressure will come from the bulbous portion 62.

As can be seen by comparing FIGS. 1 and 3, the front face 58 has a shape that will generally conform with or mimic the shape of the posterior shape of the sacrum.

The sacral support block member 44 is designed, as a rigid structure, to localize the placement of pressure, or the desired supporting and corrective force, directly on sacrum 22. In the most preferred embodiment, this force is concentrated on the upper one third of sacrum 22, the sacral base. In each of the various embodiments, however, the sacral support block member 44 is designed to apply force in a way that concentrates specific pressure or forces on and along sacrum 22, that is along a narrow path relative to other parts of the back or posterior, specifically relative to the tissues adjacent the spinal column.

When block member 44 is used by itself, it can also include a flexible, rearwardly extending tether, shown in FIG. 3 as a dotted line 66. Such a tether 66 allows the block to be used by itself, without the additional bladder 48, and to be positively positioned and held in a seat or chair. The block member 44 and tether 66 are easily positionable so that an individual can place block member 44 at the point it is needed and tether 66, by sliding between the seat bottom 12 and seat back 14, will hold block member 44 in that position. Tether 66 can be made of any flexible material, preferably plastic, but a textile material, such as a stiff length of woven or knitted synthetic yarn, could be used as well. Also, tether 66 could be molded integrally together with block member 44. Alternatively, tether 66 could be separately constructed and then attached to block member 44 by any convenient method.

As referenced previously in some embodiments the sacral support block member 44 works in conjunction with an outlying support 48 so that parts of an individual's back, adjacent sacrum 22, can be supported in specific relationship to the support provided by and the force being applied by the sacral block member 44. When the fluid volume of support 48 is adjustable, the force applied by block member 44 can be adjusted. This, in turn, will develop the appropriate positioning of the pelvis and the lower portion of the spine to best minimize compressive, bending and shear forces in the spine when seated.

Sacral support block member 44 does not extend across a large portion of the width of an individual's back. Similarly, it does not extend across a large portion of a seat back. Rather, it concentrates application of pressure or force along a relatively narrow band and thus isolates application of the desired force and support to a relatively narrow area. While not essential, it is preferred that the sacral support block member 44 have a shape that is larger across its width at the top and narrower at the bottom 64. This produces a block having a generally inverted triangular shape.

The dimensions of the rigid sacral support 44 can be, for example, approximately 2½ inches in width across the top surface 56, as seen in FIG. 2, with approximately a width of the bottom 64 of about 1 inch. The overall height, from the bottom surface 64 to the top 56, can be, for example, about 5 inches.

With reference to FIG. 3, the front to back thickness across the top surface 56 from the rear surface 54 to the front sloped surface or ramp 60 is about 0.75 inch, whereas the forwardmost portion of the enlarged area 62 from rear surface 54 is about 1.5 inch.

Satisfactory size ranges for sacral support block member 44 will vary according to an individual's height, with the following table showing roughly the dimensions for a small adult frame weighing about 150 lbs, a normal adult size frame weighing about 150–190 lbs and a relatively large adult frame weighing more than about 190 lbs.

| | Small | Normal | Large |
|---|---|---|---|
| Height | 3.5 | 5.0 | 6.5 |
| Top Width | 1.7 | 2.5 | 3.25 |
| Bottom Width | 0.7 | 1.0 | 1.3 |
| Top Thickness | 0.5 | 0.625 | 0.75 |
| Bottom Thickness | 1.0 | 1.5 | 2.0 |

For this rigid sacral support block the top to bottom width ratio is about 2.5:1 but could range from 1.5:1 to about 3:1. Likewise, the top to bottom thickness ratio is inverse to the width and is preferably about 1:2 but could range between 1:1 and 3:1 depending on the inclination of the device from vertical.

However, the top width of block member 44 can vary from 3 times the width of the sacrum at the sacral base to a dimension approximately equal to the width of the posterior portion of the sacrum 22 still at the level of the sacral base and decrease progressively to the bottom of the block member 44 where the width is greater than or equal to the width of the sacrum 22 at that point.

Figure 6:
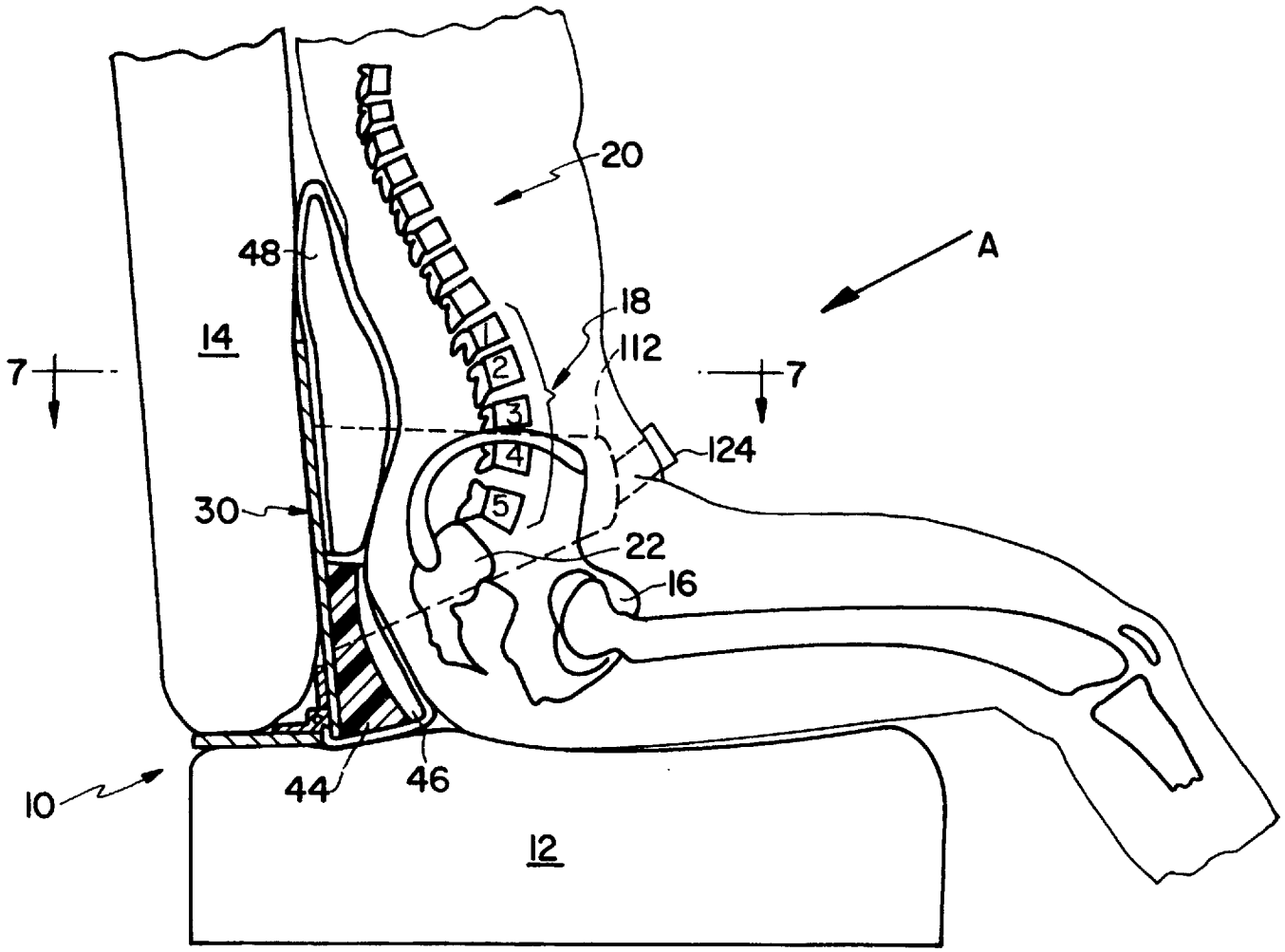
FIG. 6 is a cross-sectional view of another embodiment of the present invention.

As noted previously, the front surface 58 includes the sloped or curved portion 60 and a bulbous portion 62 or an elongated curvature, such as, for example, is shown in FIG. 6. FIG. 1 shows that the top surface 56, when block member 44 is positioned on a seat in its preferred location and an individual is seated back in the seat, will be located approximately at a level with the sacral base line 26. Block member 44 will extend downwardly from that point to the top of bottom seat 12 and the anterior surface 58 (FIG. 3) curves or extends forwardly in a progressive manner from top to bottom. This provides continuous and increasingly forwardly directed pressure on the sacrum 22 which is itself curving forward away from the rear seat back 14.

The block member 44 is designed to preferably extend horizontally adjacent the sacral base line 26, a distance approximately equal to twice the width of the posterior portion of the sacrum 22. This is shown, for example, in FIG. 7. However, this horizontal distance could vary from 30% to 300% of the width of the posterior portion of the sacrum 22, measured at the sacral base line 26, and decrease progressively to the bottom of the block member 44 where the width is about 30% to 300% of the sacrum 22's width at the bottom of block 44.

We have found that when using a rigid sacral support member 44 of the type just described is fitted in an office chair, the support device 10 will produce sacral pressures in the range of 1 to 2 psi, and that those pressures provide suitable pelvic stabilization. In most office chair configurations, only the combined mechanisms of friction and gravity will hold an individual back against the support block. Thus, forces greater than 1 to 2 psi will generally not be obtainable.

When the device according to the present invention is fitted in an automobile seat, however, where friction and gravity are aided by the additional presence of a seat belt, sacral pressures within a range of 2 to 4 psi can be generated with a corresponding greater degree of pelvic stabilization.

Such pressures have been measured where an individual was seated in a static position. When an individual would be operating pedals, or move or be braced during cornering, those pressures will vary and can increase to 10 psi or more, depending upon the amount of exertion and vehicle speeds.

When support 48 is an air bladder it is generally inflated to a pressure less than about 50% of the pressure exerted by the sacral pressure block member 44. We have found that when the air bladder 48 is inflated to a pressure greater than about 50% of the pressure indicated on a sacral pressure gage for measuring pressure exerted by the rigid support block member 44, the sacral pressure losses its effectiveness in providing pelvic stabilization. For example, with an initial applied sacral pressure value of 2 psi when seated, inflation of the air bladder 48 to 0.3 psi relieved the value of the sacral pressure applied by block 44 to downwardly to a value of 1.2 psi. This lower pressure still provided effective pelvic stabilization. However, when the air bladder 48 was further inflated to 0.5 psi, the applied sacral pressure value fell below 1 psi and pelvic stabilization was no longer adequate.

Figure 4:
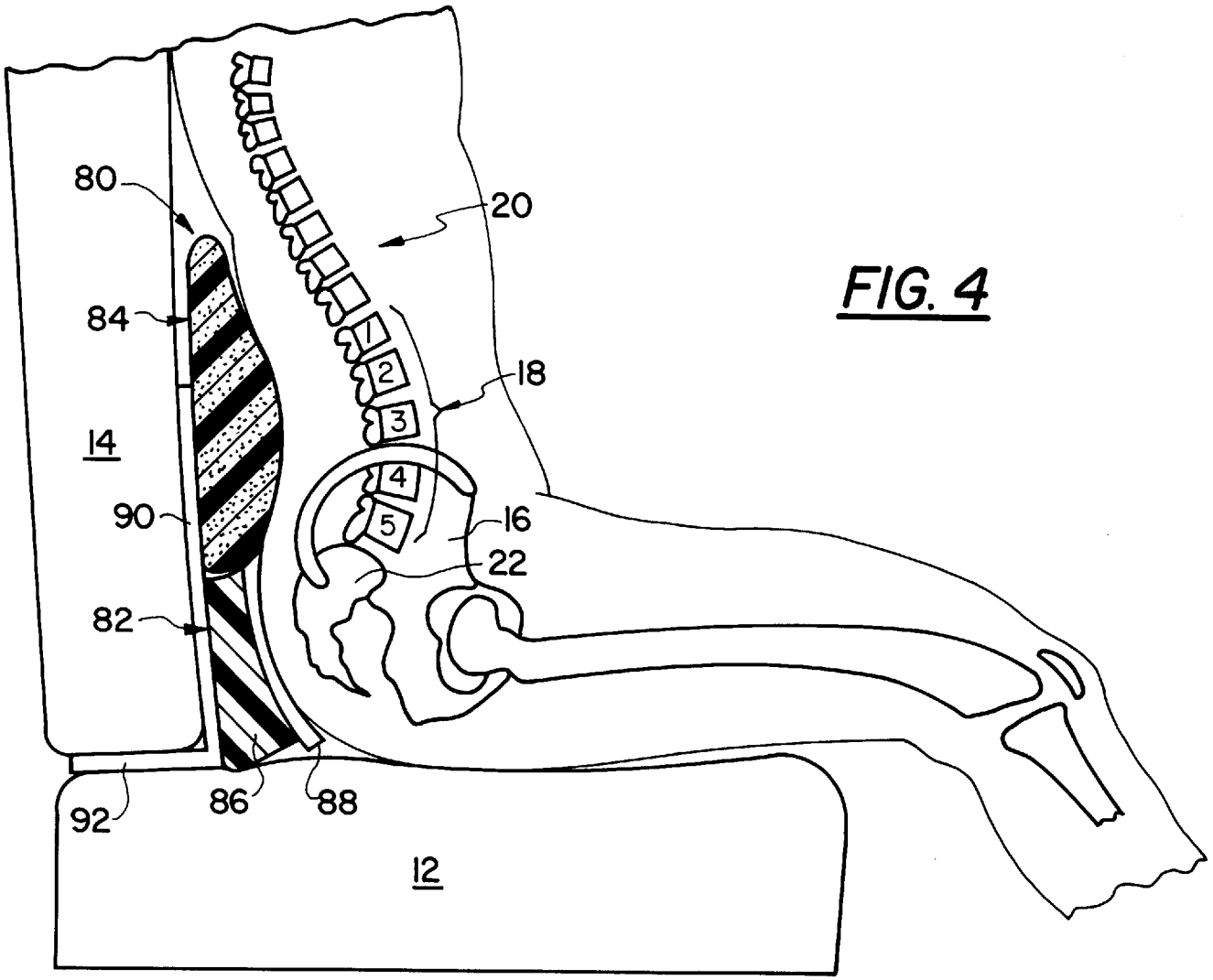
FIG. 4 is a cross-sectional view of a modified form of the present invention.

FIG. 4 shows a second embodiment of the present invention. This embodiment continues to show use with a car seat having a bottom seat 12 and a back seat 14. The pelvis is shown at 16, the sacrum at 22, the lumbar vertebrae at 18 while the thoracic vertebrae are generally indicated at 20.

In this embodiment, the device is generally indicated at 80 and includes a back support 82, an upper or exterior support 84 and a rigid support block member 86. The rigid support block member 86 can also be provided with a cover 88, although the latter is not essential. This cover can be either in the form of padding, a hydraulic bladder or a combination of those elements. As shown in FIG. 4 the cover 88 is a fixed volume, fluid filled bladder.

Figure 5:
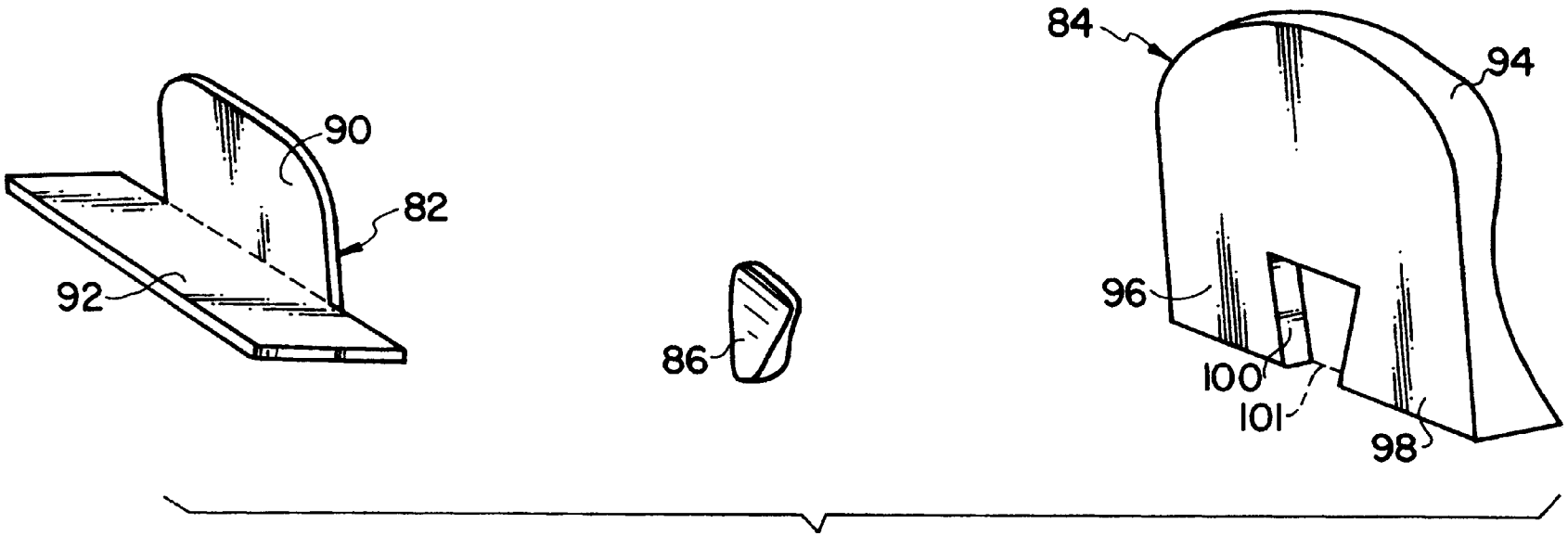
FIG. 5 is an exploded perspective view of the embodiment of the present invention shown in FIG. 4.

In this embodiment, back support 82 is preferably a molded, one piece structure that is generally L-shaped, a perspective view of which is shown in FIG. 5. The back support 82 can included a vertical upright portion 90 and a rearwardly extending portion or tether 92. As shown, the back support 82 is formed as an integral one piece unit and can be constructed of a variety of materials, including plastics, semi-rigid or rigid foams or even metal. It is preferred, however, that the rearwardly extending portion 92 have some flexibility so that it can accommodate various shapes and curvatures that may exist between bottom and rear seats.

FIG. 5 also shows, in an exploded fashion, the upper and side support member 84, as well as the rigid support block member 86.

The support 84 will again have a generally U-shaped form with an upper portion 94 and two side portions, 96, 98.

Cover 88 or block 86, both shown in FIG. 4, could also be formed directly from the foam material used to produce the support 84. Such a cover could simply be an additional front surface that spans across the interior side of opening 100 with the bottom of that cover structure being shown by dotted line 101 in FIG. 5. Alternatively, cover 88 could be a padded textile material or, as with prior embodiments, a variety of other materials or combinations thereof.

Block member 86 preferably has a shape and configuration similar to that previously discussed with respect to block member 44. Here again, it is preferred that the block 86 be molded from plastic formed from another rigid material.

In use, block member 86 could be used with a reduced or smaller version of the support 82, or by itself, or it could be used in a combined fashion, as shown in FIG. 4, with the back support and the upper support 84. In the latter case the separate elements would operate collectively as a back and lumbar support assembly.

The foam used to produce support 84 would be of a resiliency or density suitable to provide some additional support for the individual in a lumbar area, but not so much a support that the specific pressure sought to be provided by block 86 was either relieved or not. For example, the foam used for member 84 could be polyurethane, EVA or foam rubber. Where foam is used a foam density preferably of about 2 to about 20 pound per cubic foot is preferred.

The size and dimensions of block 86 remain similar to those described above for block 44.

It should also be understood that the whole assembly 80 could be formed as an integral unit, and molded with varying densities of plastics or foams. This would result in a one piece structure that could be conveniently used by an individual, and even carried from one seating environment to another. In that way, the device could first be used in an automobile while travelling to and from work, and then carried into the office and next used in that individual's office chair environment to provide additional sacral support during the work day. After work, the device would again be used in the car for the trip home.

Figure 7:
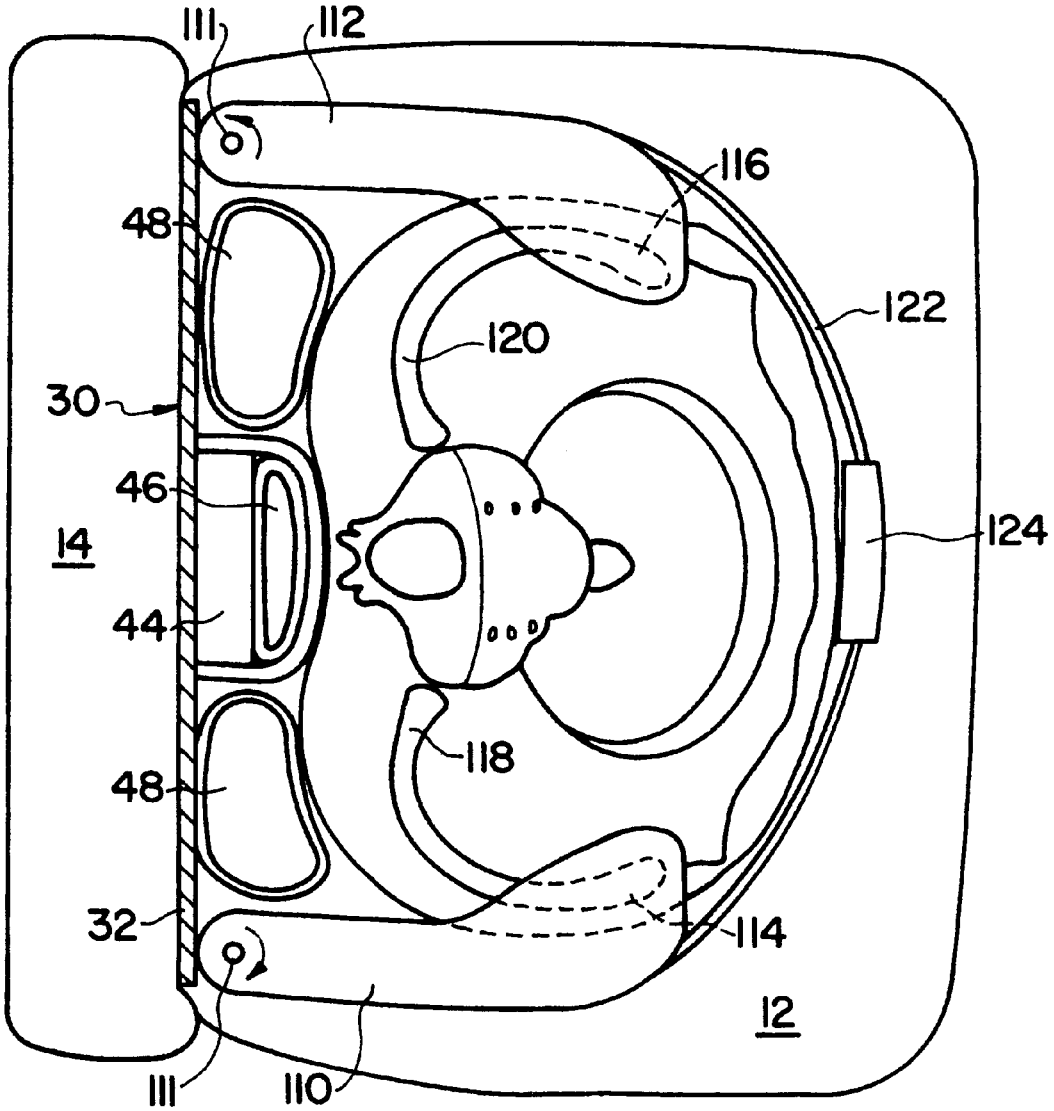
FIG. 7 is a cross-sectional view taken along line 7—7 in FIG. 6.

Another embodiment of the present invention is shown in FIGS. 6 and 7, and could be a modified version of either prior embodiment as shown in FIGS. 1–3 or FIGS. 4–5, respectively. The base support as shown, for example, could be the back support, generally indicated at 30.

The device that is shown being used with respect to the bottom seat 12 and the back seat 14 is the device generally indicated at 10 which includes a base member, generally indicated at 30, an air bladder 48, a rigid sacral support block member 44 with a hydraulic bladder 46 provided thereover. The difference between this and the FIG. 1 embodiment is the use of side bolsters 110 and 112. Bolster 112 is shown in dotted line in FIG. 6 and both are shown in the FIG. 7 top plan view. Bolsters 110 and 112 are pivotally connected at 111 to the back brace 32 so that each bolster can pivot outwardly away from the individual, as shown by the arrows adjacent points pivot 111. This pivot 111 connection can be by hinge or other convenient mechanism (not shown in detail), the only requirement being that bolsters 110 and 112 are pivotable toward and away from an individual sitting on seat bottom 12.

As shown in FIG. 7, each bolster 110 and 112 can include an upward, inwardly curving portion shown at 114 and 116, respectively. These inwardly curving portions are designed so that they will come up over the hips of the seated individual, as shown in FIG. 7, and also allows them to extend over the iliac crests, shown respectively at 118 and 120. The front portions of the side bolsters 110 and 112 are connected together by means of a lap belt 122 and a suitable buckle 124 which will permit the belt to be snugly tightened around the individual. This combined belt and bolster assembly will tend to apply pressure in the direction shown by the arrow A in FIG. 6. Belt 122, together with the bolsters 110 and 112, will capture the iliac crests of the seated individual and will thereby prevent movement of the pelvis 16.

This support system shown in FIGS. 6 and 7 can also be used in a race type vehicle, which has a three to five point restraint system, to accommodate higher gravity G force requirements. In this situation, the support elements could be customized for an individual driver and constitute part of an integrated, customized seat and support structure. The function and operation of the elements would be the same, however, the conditions, reactions and forces would simply be more severe.

FIGS. 8 through 12 show an additional, mechanically adjustable, embodiment of the present invention.

Figure 8:
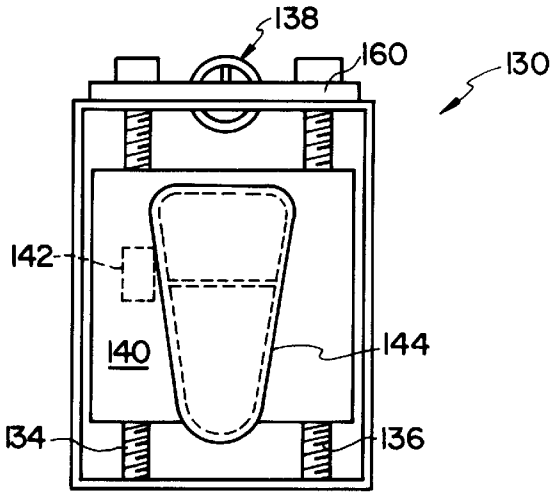
FIG. 8 is a front view of another embodiment of the present invention.

As shown in FIG. 8, the support apparatus, generally indicated at 130, is comprised of an outer frame 132 in which two pivotally mounted threaded rods, 134 and 136 respectively, are pivotally mounted. A rod drive assembly, generally indicated at 138, is provided to rotate rods 134 and 136. This operation will be described further below.

Figure 12:
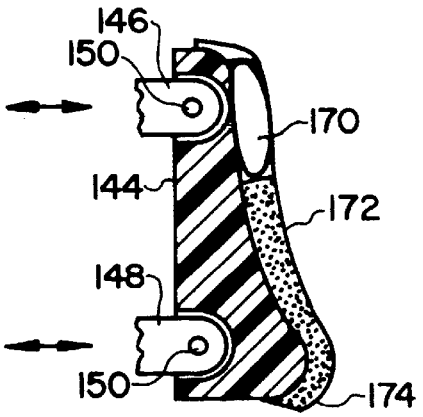
FIG. 12 is a vertical, partial cross-section through the support block.

A face plate 140 is connected to each of rods 134 and 136 by suitable threaded bearings, one of which is shown in phantom at 142. This permits face plate 140 to traverse vertically within frame 132. A sacral support block 144 is connected to face plate 140 by means of upper and lower supports 146, 148, respectively, which, as shown in FIG. 12, are connected to block 144 by pin connections 150. The pin connections 150 permit the ends of each support 146 and 148 to pivot and thus move relative to the sacral support block 144.

Figure 9:
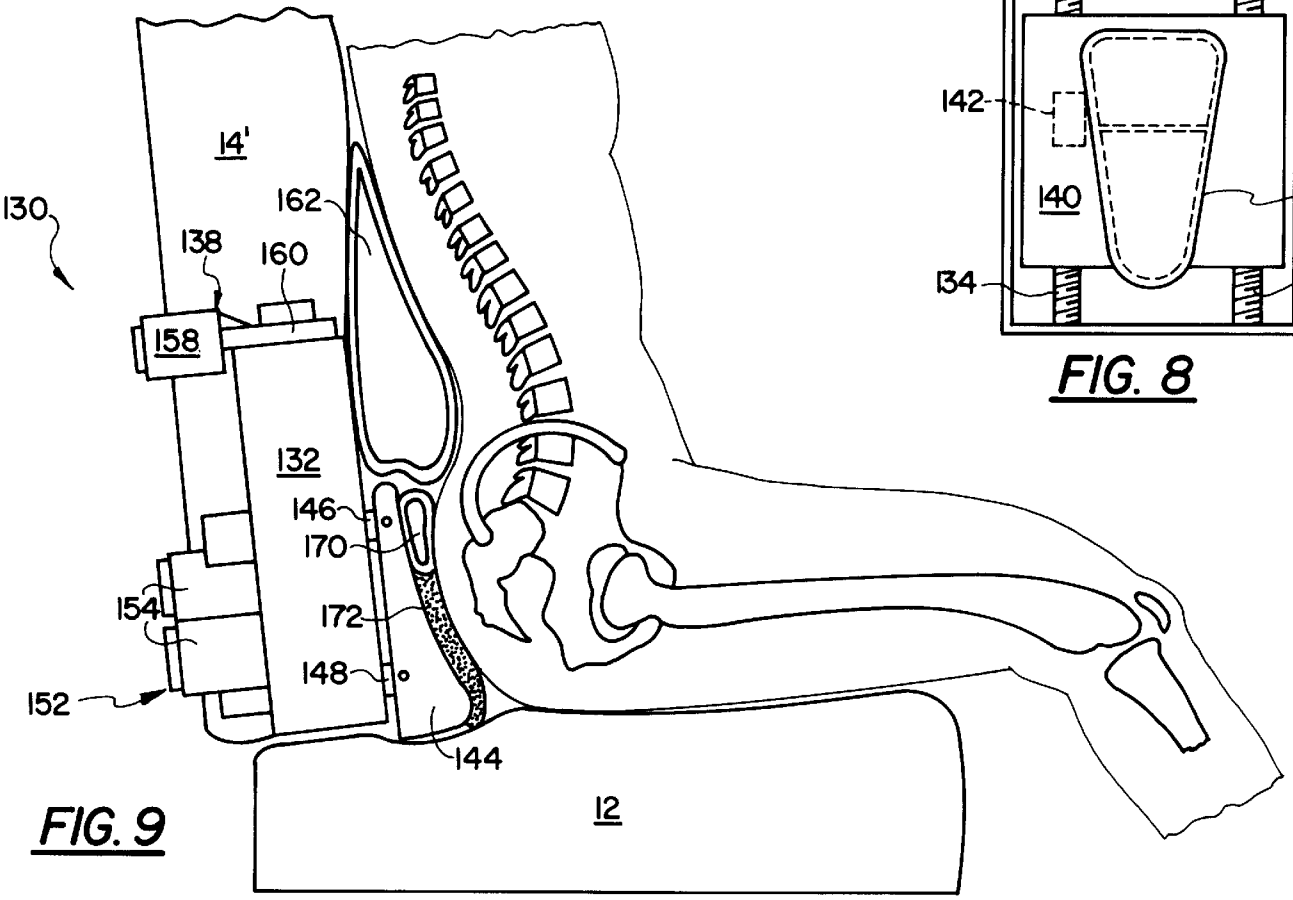
FIG. 9 is a side elevational view thereof as positioned in a seat relative to an individual.
Figure 10:
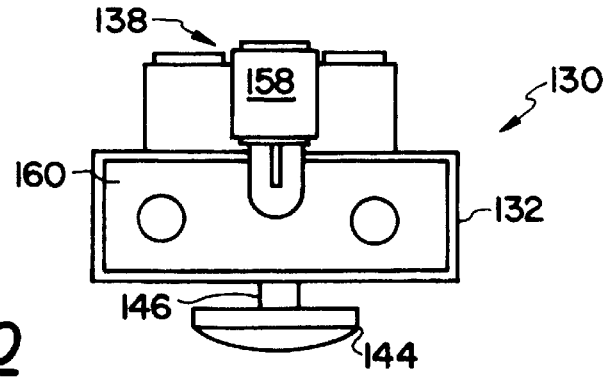
FIG. 10 is a top plan view thereof.
Figure 11:
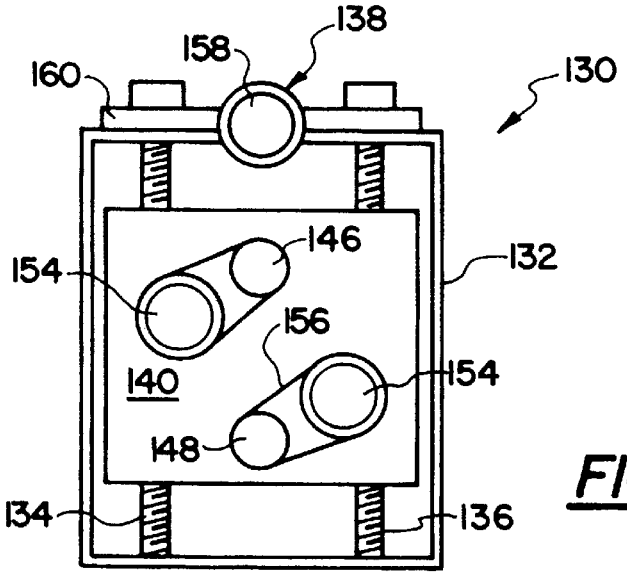
FIG. 11 is a front elevational view with the sacral support block removed.

Supports 146, 148 each extend rearwardly, through face plate 140, within frame 132, and into a suitable block drive assembly, generally indicated at 152. The upper and lower supports 146 and 148 can either comprise threaded rods, at least the interior end of which is threaded, or, alternatively, they can comprise piston rods. What is required is a way to permit support block 144 to be manipulated or moved. The block drive assembly 152 is provided to move upper and lower block supports 146 and 148, either uniformly or unilaterally, inwardly and/or outwardly relative to frame 132. In this way, the sacral support block 144, or its upper or lower portion, can be moved toward and away from frame 132 and thus, as shown in FIG. 9, toward and away from an individual in a seat. Because upper and lower block supports 146 and 148 can move independently of one another, it is possible to cause block 144 to articulate in a way designed to best provide support for an individual. Consequently, the top or the bottom of block 144 can be positioned so that the block itself can be located at varying angular positions, relative to each other and relative to the plane established by face plate 140 or the seat back 14' (FIG. 9). Thus, block 144 can be positioned differently from the position as shown in FIG. 9.

The sacral support block drive system 152 can be comprised of one or more electric motors 154, which in turn drive suitable gear assemblies to cause the upper and lower block supports 146, 148 to move inwardly or outwardly, as shown by the double arrows in FIG. 12. Such a gear assembly is generally indicated at 156 in FIG. 11, and can include suitable gearing so that when operatively connected to drive motor 154, block supports 146 and 148 will be moved in a desired direction. This drive system could also be controlled in a way similar to the way car seats with finger controls can be moved, or via a memory system. These are now conventional and further description is not necessary.

Drive assembly 138 also includes an electric motor 158, and a suitable worm gear drive 160 that connects directly to the tops of rods 134 and 136 and causes them to operate in a clockwise or counterclockwise direction.

Sacral support block 144 can be a rigid member or, alternatively, as shown in FIG. 12, could include a hydraulic bladder 170, located along the upper one-third of the support, with the lower two-thirds being covered by a foam pad 172. For aesthetics, a fabric cover 174 could extend over both the bladder 170 and the foam pad 172. In this configuration, the hydraulic bladder 170 is relatively incompressible whereas the foam portion, in the lower two-thirds, is compressible. It should also be understood that the hydraulic bladder 170 could have its internal volume adjustable, as in the earlier embodiments, so that the overall support could be adjusted for each individual user.

It should also be understood that this form of the support block 144 could be used by itself, as with blocks 44 and 86. Also, block 144 could be provided, in that case, with a tether similar to tether 66.

As shown in FIG. 9 the support assembly 130 could also include a larger fluid bladder 162 that would be similar to bladder 48 shown in FIG. 1. Consequently, further discussion of that bladder, and its utility in the support system of the present invention, is not required here.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A spinal support device for use with seats in order to apply specific support pressure to the sacral portion of the spine comprising a support member placed where a seat back and bottom meet, said support member having at least top, opposing side and front surfaces providing support to the sacral portion of the spine by concentrating force on and along the upper portion of the sacrum, said support member being configured to extend across substantially only the sacrum portion to support and stabilize the remaining portion of the sacrum and to allow the adjacent articular structures to relax to the seat, and an anchor member to which said support member is attached.

2. A support device as in claim 1 further including a padding member extending across at least a portion of said front surface.

3. A support device as in claim 2 wherein said padding member is comprised of foam.

4. A support device as in claim 2 wherein said padding member is comprised of a hollow bladder.

5. A support device as in claim 1 wherein said padding member is a fluid filled chamber.

6. A support device as in claim 1 wherein said anchor member includes an upstanding portion, attached to said support member, and a seat engaging portion.

7. A support device as in claim 6 wherein said seat engaging portion is flexible.

8. A support device as in claim 6 wherein said support member, said anchor member and said seat engaging portion are integrally formed.

9. A support device as in claim 1 wherein said support member further includes an anatomical conforming front surface.

10. A support device as in claim 9 wherein said anatomical conforming front surface comprises a foam layer.

11. A support device as in claim 9 wherein said anatomical conforming front surface comprises a fluid filled chamber.

12. A support device as in claim 11 wherein said fluid has a viscosity ranging from about 0.01 to about 10,000 centipoise at 20° C.

13. A sacral support for use with a seat having seat back and seat bottom portions, said support directing and concentrating force anteriorly on the posterior of the sacrum and comprising a support member having seat contacting rear and bottom surfaces and a shaped anterior surface that extends from a position substantially level with the sacral base line to the surface of the bottom seat portion and horizontally a distance of about twice the posterior portion of the sacrum adjacent the sacral base line so that the support member extends across substantially only the sacrum to thereby apply an anterior force that is concentrated on the upper portion of the sacrum of a seat user and the remainder of the sacrum is stabilized.

14. A sacral support as in claim 13 wherein said member has a top portion with a greater horizontal width dimension than a bottom portion thereof.

15. A sacral support as in claim 14 wherein said member has a top portion to bottom portion width ratio of about 2.5:1.

16. A sacral support as in claim 14 wherein said member has a top portion to bottom portion thickness ratio of about 1:2.

17. A sacral support as in claim 13 wherein said member further includes a bulbous portion extending anteriorly from a lower portion of the anterior surface.

18. A sacral support as in claim 14 wherein said member further includes a bulbous portion extending anteriorly from a lower portion of the anterior surface.

19. A sacral support as in claim 13 wherein said member further includes padding extending across said anterior surface.

20. A sacral support as in claim 19 wherein said padding comprises a fabric material.

21. A sacral support as in claim 19 wherein said padding comprises a foam material.

22. A sacral support as in claim 19 wherein said padding comprises a fluid filled bladder.

23. A sacral support as in claim 22 wherein the fluid comprises air.

24. A sacral support as in claim 22 wherein the fluid comprises a liquid having a viscosity ranging from 0.01 to 10,000 centipoise at 20° C.

25. A sacral support as in claim 13 further including a support member having an upstanding portion connection to said member and a generally rearwardly extending portion.

26. A sacral support as in claim 25 wherein at least said rearwardly extending portion is flexible.

27. A sacral support device for exerting isolatable and concentrated pressure on a designated spinal area along a portion of the sacrum comprising a support member for use in a seat and configured to extend substantially across only the sacrum, said support member having at least top, opposing sides and front surfaces, said front surface having an anatomically accommodating curvature and a stabilizing member extending at least partially about said top and opposing side surfaces to assist in stabilizing structure adjacent the sacrum and a seat accommodating anchor to which said support member is attached.

28. A spinal support device comprised of a firm block of material having top and bottom, opposing side, front and rear surfaces, said top having a width dimension that is wider than the width of said bottom, said front surface having a concave top to bottom extending curvature and where the support device is configured to extend across substantially only the sacrum to stabilize and support the remaining portion of the sacrum and to allow adjacent portions of the adjacent articular structure to relax.

29. A spinal support device as in claim 28 wherein the material of said block is comprised of foam.

30. A spinal support device as in claim 28 wherein said block applies concentrated force to an isoletable upper one third portion of the sacrum.

31. A spinal support device as in claim 28 further including a seat engaging device.

32. A spinal support device as in claim 28 further including a size variable front surface.

33. A lower back support mechanism for use with a seat having interconnected seat back and seat bottom portions comprising:

a support member having a generally concave front surface directed toward a seated individual including upper and lower section extending anteriorly of the upper sections and where the support device is configured to extend across substantially only the sacrum to stabilize and support the remaining portion of the sacrum and to allow adjacent portions of the adjacent articular structures to relax, said support member further including a seat locating member so that when said between the back and bottom support member is positioned on the seat relative to a user of the seat and relative to the seat back and seat bottom portions said support member will produce localized pressure on the upper portion of the sacrum of the seat user articular structure in the back of the individual are likewise stabilized.

34. A lower back support mechanism as in claim 33 wherein said seat locating member is flexible.

35. A lower back support mechanism as in claim 33 wherein said seat locating member is formed as an integral part of said support member.

36. A lower back support mechanism as in claim 33 wherein said support member and said locating member are molded as an integral unit.

37. A lower back support mechanism as in claim 33 wherein said support member further includes a hydraulic bladder positioned thereon.

38. A lower back support mechanism as in claim 37 wherein said hydraulic bladder is secured onto an upper section and the padded member is secured onto a lower section.

39. A lower back support mechanism as in claim 38 wherein said upper section comprises the upper one third of the front surface.

40. A lower back support mechanism as in claim 37 wherein said support member has front and rear surfaces and said hydraulic ladder is positioned on said front surface.

41. A lower back support mechanism as in claim 33 further including an articulation mechanism operatively attached to said support member to vary the positional relationship between said support member and the seat.

42. A method of supporting the neuro-musculo-skeletal system of an individual in a seat to produce pelvic stability when in a seated position therein comprising the steps of:

placing a support member at the juncture of a back and bottom portion of a seat, and relatively positioning said support member and the individual in the seat so that force is applied and concentrated by said support member against an upper portion of the sacrum of the seated individual, said support member extending across substantially only the sacrum portion to thereby support and stabilize the remaining portion of the sacrum.

43. A method of supporting the neuro-musculo-skeletal system as in claim 42 further including the step of placing a fluid bladder around upper and side margins of said support member, and inflating the fluid bladder so that an area surrounding the sacrum is supported in conjunction with the sacrum.

44. A method of supporting the neuro-musculo-skeletal system as in claim 42 wherein said support member produces greater force against the sacral base portion of the sacrum relative to the remainder of the sacrum.

45. The method as in claim 42 including the additional steps of mounting the support member to an articulation assembly provided in the seat and progressively articulating the support member relative to the seat and the individual to apply a concentrated force against the upper one third of the sacrum of the individual.

46. A spinal support device comprising:

a support member having upper and lower sections, and a generally concave front surface directed, said lower section extending anteriorly of the upper section and where the support device is configured to extend across substantially only the sacrum to stabilize and support the remaining portion of the sacrum and to allow adjacent portions of the adjacent articular structure to relax, said support member further including a seat locating member so that when said support member is positioned on the seat, relative to the back of a user of the seat and relative to back and bottom of said seat, said support member providing localized pressure on an upper portion of the sacrum and sufficient pressure to stabilize the remainder of the sacrum and adjacent articular structure of the back.

47. A method of supporting the spine of a seated individual comprising the steps of:

applying supporting force to the sacral portion of the spine and concentrating such supporting force on the upper one third of the sacrum, stabilizing the remaining portion of the sacrum and stabilizing adjacent articular structures relative to the sacrum in a way that allows such adjacent articular structure to relax.

48. A spinal support device for applying support pressure to the sacral portion of the spine of a seated individual comprising:

a support device having a front surface shaped to extend along the sacrum to apply concentrated force to an upper one third portion of the sacrum, said support device extending across substantially only the sacrum portion to thereby support and, simultaneously stabilize the remaining portion of the sacrum, and an anchor attached to said support device.

49. A spinal support device for applying support pressure to the sacral portion of the spine of a seated individual consisting of:

a support device having a front surface shaped to extend along the sacrum to apply localized concentrated force to an upper one third portion of the sacrum and extending across substantially only the sacrum while simultaneously stabilizing the remaining portion of the sacrum to permit adjacent structures to relax there around, and a support device locating member attached to said support device.

50. A spinal support device for applying support pressure to the sacral portion of the spine of a seated individual comprising:

a support device for use with a seat, said support device having a front surface shaped to extend substantially across only the sacrum to apply concentrated force to a portion of the sacrum without applying concentrated force to tissue adjacent the sacrum, and an anchor attached to said support device.

* * * * *